US006871682B2

(12) United States Patent
Hogganvik

(10) Patent No.: US 6,871,682 B2
(45) Date of Patent: Mar. 29, 2005

(54) CREDIT CARD HOLDER

(76) Inventor: Bertil Hogganvik, Chr. IV's veg 86, N-3380 Hokksund (NO)

( * ) Notice: Subject to any disclaimer, the term of this patent is extended or adjusted under 35 U.S.C. 154(b) by 0 days.

(21) Appl. No.: 10/240,731

(22) PCT Filed: Apr. 5, 2001

(86) PCT No.: PCT/NO01/00144

§ 371 (c)(1),
(2), (4) Date: Oct. 9, 2002

(87) PCT Pub. No.: WO01/78549

PCT Pub. Date: Oct. 25, 2001

(65) Prior Publication Data

US 2003/0037851 A1 Feb. 27, 2003

(30) Foreign Application Priority Data

Apr. 13, 2000 (NO) ..... 20001922

(51) Int. Cl.[7] ..... A45C 11/18
(52) U.S. Cl. ..... 150/149; 150/147; 206/39.3
(58) Field of Search ..... 150/147, 149; 206/37, 39, 39.3, 38

(56) References Cited

U.S. PATENT DOCUMENTS

| | | | | | |
|---|---|---|---|---|---|
| 635,582 | A | | 10/1899 | Pedrick | |
| 685,333 | A | * | 10/1901 | Hunter | 206/37 |
| 983,383 | A | * | 2/1911 | Manson | 40/388 |
| 1,296,484 | A | * | 3/1919 | Cutler | 206/39 |
| 2,726,758 | A | * | 12/1955 | Brower | 206/39 |
| 3,369,585 | A | * | 2/1968 | Martinsen | 206/37 |
| 3,483,909 | A | | 12/1969 | Osher et al. | |
| 3,648,832 | A | * | 3/1972 | Kirshenbaum et al. | 206/37 |
| 4,674,628 | A | * | 6/1987 | Prinsloo et al. | 206/38.1 |
| 4,817,253 | A | * | 4/1989 | Harmatuik | 24/458 |
| 4,974,652 | A | | 12/1990 | Lemler | |
| 5,038,926 | A | * | 8/1991 | van der Toorn | 206/39.3 |
| 5,370,419 | A | * | 12/1994 | Takayama | 150/147 |
| 5,452,793 | A | * | 9/1995 | DiMeo et al. | 206/39 |
| 5,992,618 | A | * | 11/1999 | Joh | 206/39 |
| 6,155,410 | A | * | 12/2000 | Davis | 206/39.5 |
| 6,240,989 | B1 | * | 6/2001 | Masoud | 150/149 |

FOREIGN PATENT DOCUMENTS

| | | | | |
|---|---|---|---|---|
| DE | 2607664 A1 | * | 9/1987 | 281/45 |
| JP | 6113915 A | * | 4/1994 | 150/147 |
| WO | 99/21452 | | 5/1999 | |

* cited by examiner

*Primary Examiner*—Sue A. Weaver
(74) *Attorney, Agent, or Firm*—Dennison, Schultz, Dougherty & MacDonald

(57) ABSTRACT

Card holder, especially for plastic cards with readable data unit, such as credit cards and/or smart cards, with externally hinged covers (1, 2) made of a rather rigid material constituting the walls of the card holder as each of the covers (1, 2) at or near the ends which are not hinged together, has at least one mutually conjunctive locking mechanism (4) to hold the card holder locked when it is not being used. The card holder has, two paired, mainly identical, holding devices (5, 6) at opposite sides, said holding devices (5, 6), preferably, being hinged together with the covers (1, 2), and having a number of paired, opposing holding surfaces (11, 12) to enclose an area along the side edges of cards of the above mentioned type. The holding surfaces (11, 12) are mainly parallel to each other both when the card holder is open and closed. The card holder preferably comprises a spring mechanism (8, 10), which exerts pressure outwards on the hinged covers (1, 2) when closed, and which assists in the opening of the card holder when the locking mechanism (4), which keeps the card holder closed, is released.

13 Claims, 3 Drawing Sheets

CREDIT CARD HOLDER

FIELD OF THE INVENTION

The present invention concerns a cartridge or card holder for cards, especially plastic cards with a data reading device, such as credit cards and/or so-called smart cards.

DESCRIPTION OF RELATED ART

There are numerous devices designed to store and protect cards of the credit card type, and there are lots of considerations that need to be addressed to ensure ideal storage of these cards.

It is common for such cards to be stored in specially designed pockets in pocket books. Such pockets are by preference made of a soft fabric, which provides the cards with some protection, a.o. against damage from contact with sharp objects.

It is, however, in the nature of pocket books and wallets, to be relatively soft, and, over time, this will cause some deformation (curving) of the cards and, as a result the magnetic strip risks becoming unreadable.

Furthermore, the card may be charged with static electricity when it is taken out and replaced. A third problem associated with storage of the card in a wallet, is the loss, not only of cash, but also of "plastic money," should one be so unfortunate as to lose it or have it stolen.

Several types of separate card holding devices are known. The majority of them suffer from the type of shortcomings mentioned above, except that the cards are not stored together with cash.

U.S. Pat. No. 3,483,909 features a detachable bellow-shaped insert designed for a wallet, in which such cards can be inserted in a number of pockets, for instance, six. Nothing, however, hinders the user in putting more than one card in one pocket.

Storing cards in this way means that the entire surface of the cards, including the area in which information is stored, will be in contact with the card holder. Furthermore, the cards can easily fall out should the card holder by accident be turned upside down.

U.S. Pat. No. 4,974,652 features a variant of a separate card holder, with bellow-shaped side walls, that have been designed to enclose an area along the short sides of the card. This means that the cards can be stored separately without contact between the card and the card holder in the entire length of the cards.

This is an improvement over many other card holders, since it means that the area(s) in which magnetic information is stored will, to a lesser extent will come in physical contact with the card holder.

This card holder does have some drawbacks, however. The cards can easily fall out, should the storage device be turned upside down while open. To some extent this may be counteracted by adjusting the size of the card holder relative to the cards, so that the cards can barely be pushed in, against some friction.

This will however, in its turn create difficulties when a card is to be pulled out of a card holder filled with cards, since the bellow-shaped side walls need to be pulled out far enough to allow the user to see which card lies where, and then to pull it out by grasping its end.

The wider you open the card holder, the greater the force from the side walls will be pressing against the sides edges of the card. This means that more force will be required to pull a card out. Another drawback is that it is possible to insert more than one card in every pocket, so that, for instance, two cards may end up with their magnet strips rubbing against each other.

SUMMARY OF THE INVENTION

The object is therefore to provide a card holder for cards of the credit card type, in which the readable area on the cards is protected against damage as a result of physical contact with other cards or other elements near the cards.

Furthermore, the object is to provide a card holder for cards of the credit card type, in which the readable information on the cards is protected against the type of damage specified above by ensuring that the cards remain at a fixed distance from one another, so that the readable units will only be in contact with air.

Furthermore, the purpose is to provide a card holder for cards of the credit card type, in which the cards are protected from external physical influence.

It is a still further object to provide a card holder for cards of the credit card type, in which the cards are protected against dirt and dust.

Furthermore, it is an object is to provide a card holder that minimizes the risk of cards falling out when open but which still makes it simple to get hold of and extract any card from the card holder.

It is a still further object to provide a card holder for cards of the credit card type which is small and which can be manufactured at a low cost.

BRIEF DESCRIPTION OF THE DRAWINGS

Below a closer description of one design of the invention is provided, with reference to the enclosed drawings, where.

DESCRIPTION OF THE PREFERRED EMBODIMENTS

Figure 1:
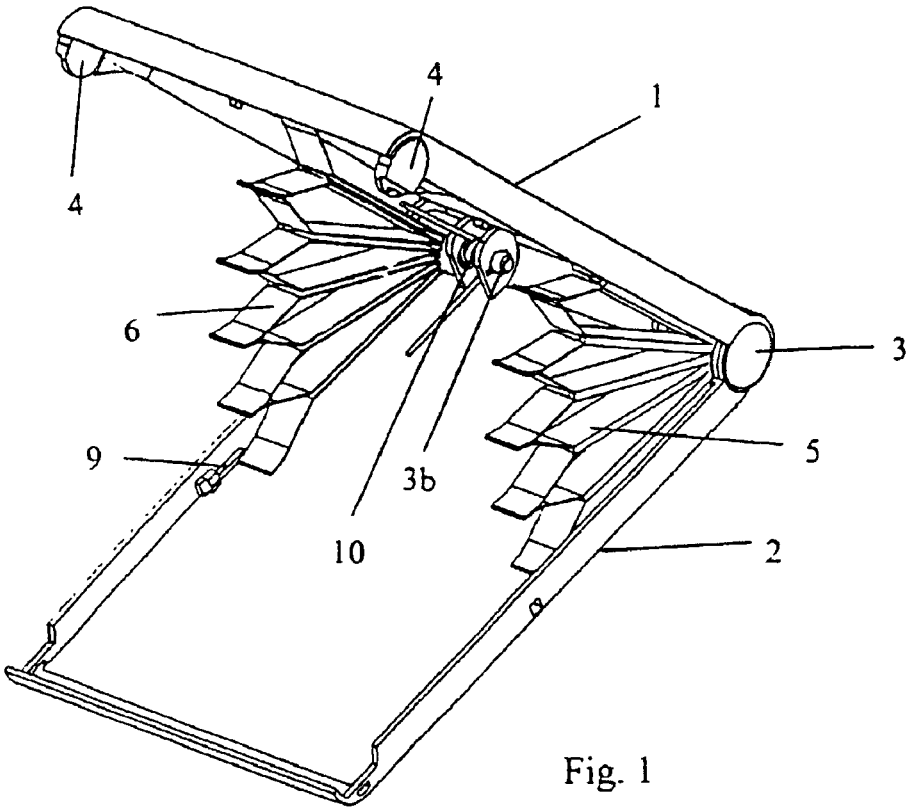
FIG. 1 shows a card holder according to the invention, in an open position.

FIG. 1 shows a card holder with covers 1 and 2, hinged together with a conventional hinge mechanism 3, 3*b*, which may be split or go straight through the card holder. The pair of external covers 1 and 2 open in intersecting planes 20 and 22.

At the opposite end of the covers relative to the end where they are hinged, snap locks 4 are shown. At the end of the card holder, where the covers are hinged, there are also two holding devices 5, 6, which preferably are identical, the construction of which constitutes a vital element of the present invention.

Figure 2:
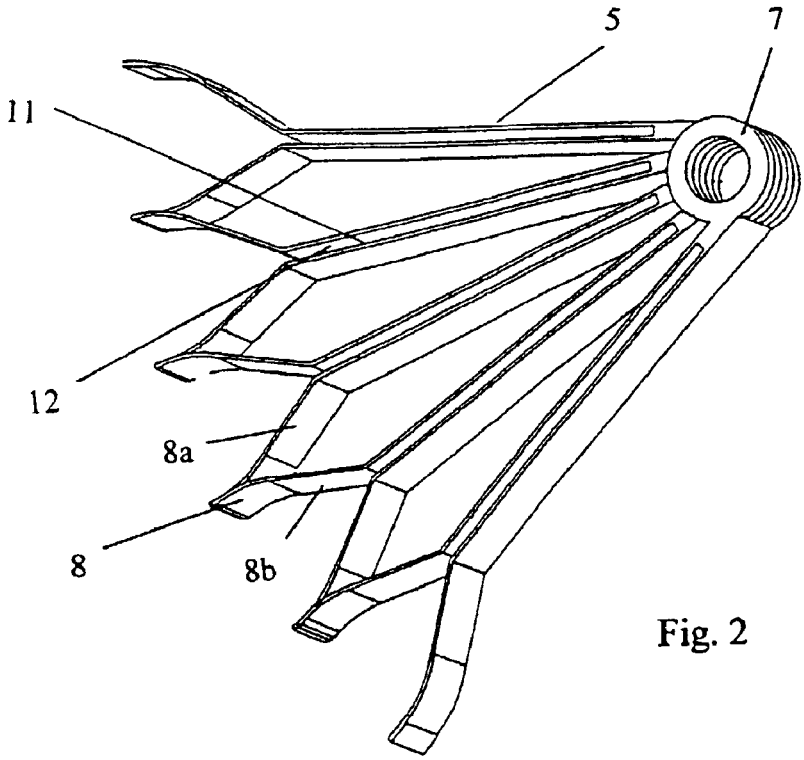
FIG. 2 shows, magnified, a holding device for a card holder according to the invention, prior to its installation in a card holder.

FIG. 2 shows a preferred design of a holding device 5 or 6. It is produced in one piece, for instance, by casting, using a thermoplastic material, but it can also be produced partially or entirely of metal.

Figure 3:
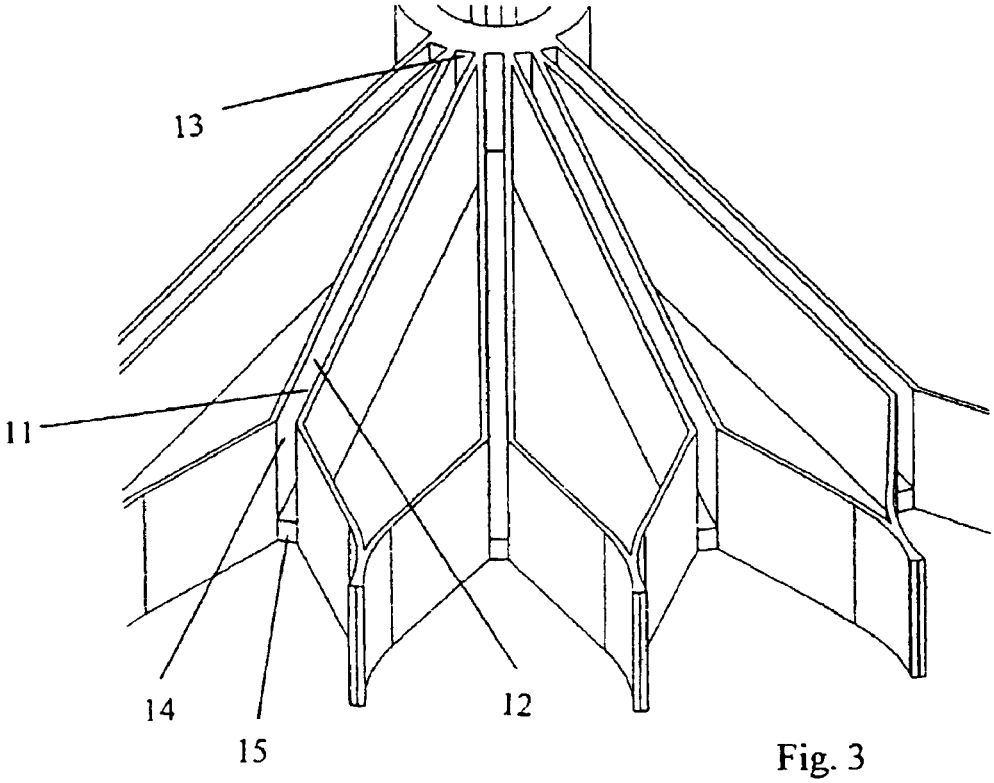
FIG. 3 shows, further magnified, details of the holding device shown in FIG. 2.

The holding device has a number of paired opposing holding surfaces 11, 12, which are mainly parallel, and which will remain mainly parallel both when the card holder is completely closed and when it is fully open. This is more clearly illustrated in FIG. 3

These mainly parallel holding surfaces are designed to enclose an area along the side edges of a card, that is to say, an area of the card where no information is stored. At that end of the parallel holding surfaces which will face the card holder's hinge 3 when the holding device 5, 6 is mounted, the parallel surfaces 11, 12 are connected by means of a short end piece 13, in such a way that one couple of parallel holding surfaces and one end piece form a U.

At the bottom of this U-shaped piece a ring-shaped hinge member 7 is shown, hinged on the same axis 3*b* as the covers. On the illustrated design the hinge member 7 is divided into separate elements 7*a*, 7*b* etc so that there will be such a hinge member at the bottom of every single U-shaped piece. This gives the holding device a particularly stable design.

When a holding device 5 or 6 is to be inserted into the card holder, it must be compressed at the end which forms the bottom of every U-piece, so that the elements 7*a*, 7*b*, etc, which make up the hinge member 7 overlap one another, and can be threaded on to one and the same shaft 3*b*.

Figure 4:
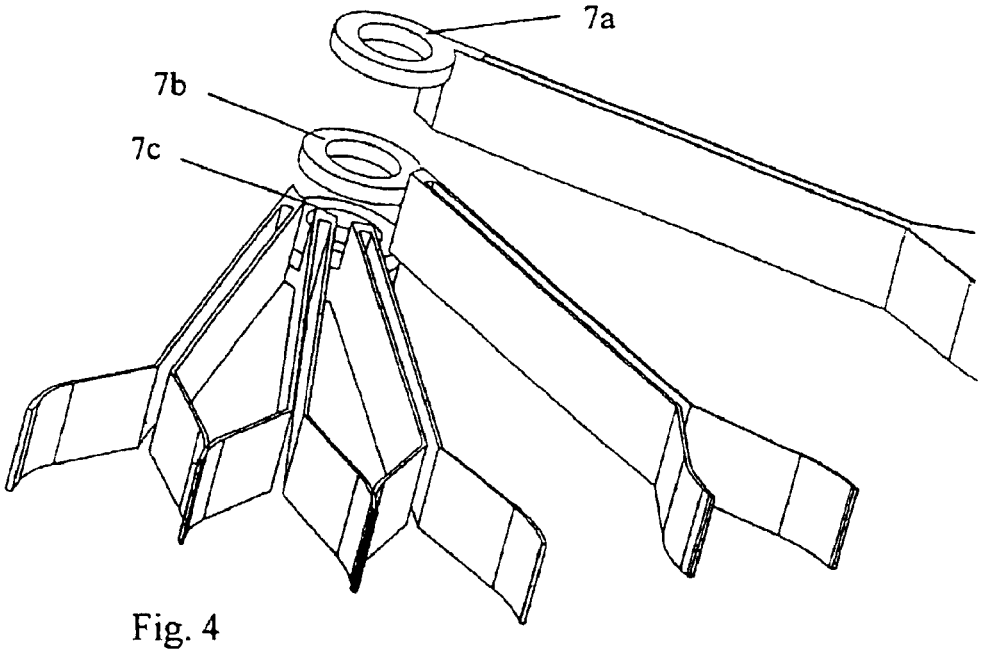
FIG. 4 shows other details of such a card holding device as shown in FIG. 2.
Figure 5:
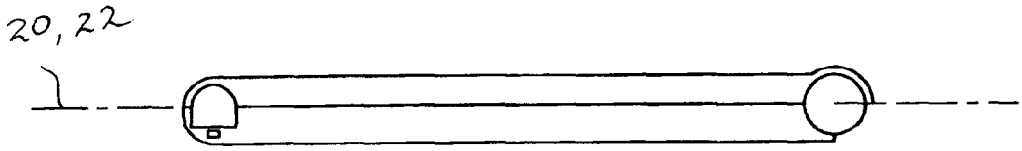
FIG. 5 shows a side sectional view of the card holder in a closed, position.
Figure 6:
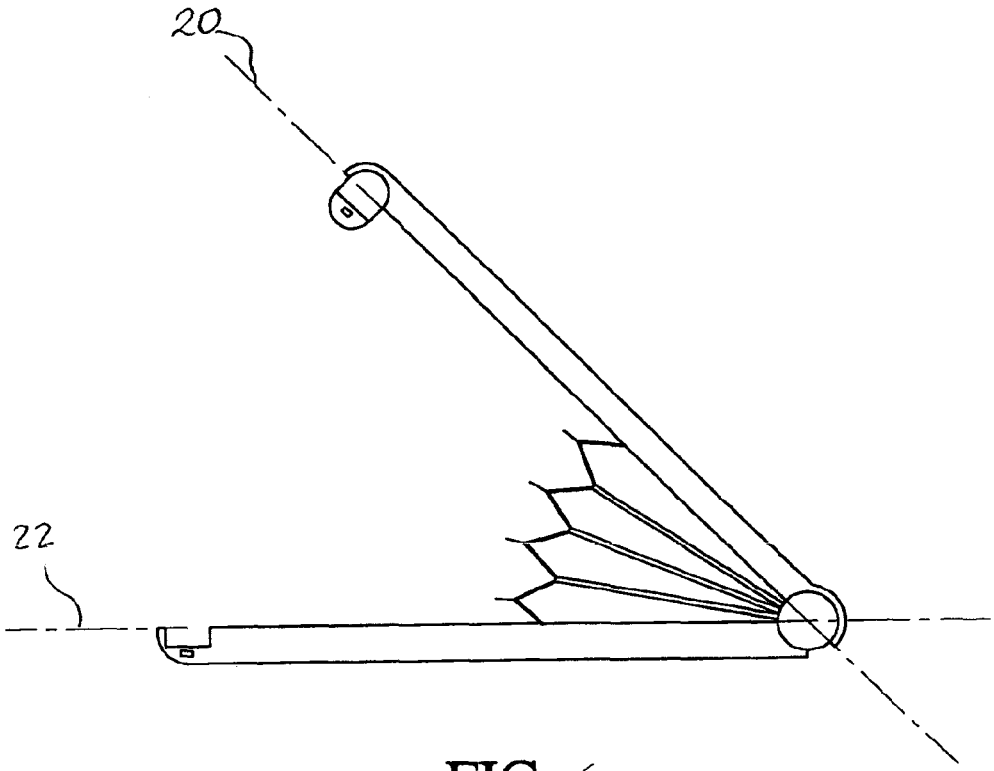
FIG. 6 shows a side sectional view of the card holder in an open position with the pair of covers opened in intersecting planes.

As best indicated by FIG. 4, the various elements 7*a*, 7*b* etc, which make up the hinge member 7, will be displaced sideways relative to each other so that when the holding device is compressed at this end, as indicated above, these elements together form a hinge member 7 that assumes the shape of a ring with approximately the same shaft thickness as the width of each holding surface (U).

FIG. 4 shows parts of the holding device 5 or 6 separated from each other, but it should be underlined that this is only done for the sake of illustration in order to focus on various details, as the holding device normally will be produced as one single integrated piece.

It is especially preferable to have such an element $\mathbf{7}_{(index)}$ at the bottom of every U, so that the number of elements of the hinge member is mainly equivalent to the number of card slots in the card holder, as this constitutes an especially stable design. This may, however, be different for different embodiments.

The above mentioned parallel holding surfaces 11, 12 are of necessity open along the long sides 14, which in an assembled position face inwards into the card holder, so that cards can be inserted between the surfaces. At the opposite long sides, which face outwards towards the wall of the card holder when the holding device is assembled the U-piece is preferably closed along all or parts of its length with side elements 15, to keep a card from being displaced sideways. The width of the holding surfaces 11, 12 will, in a typical design, be 4–6 mm, while the length typically will be 20–35 mm. Other dimensions are possible.

At the top of every U-piece there is, for every one of the surfaces that constitutes this U, a connecting piece 8 over to each of the neighboring surfaces of the closest U on either side. As for the outermost U-piece on either side, the outer connecting surface leads to a special fixing device 9 designed to be fixed to the cover.

These connecting pieces 8, which by preference have the same width as the parallel surfaces which make up the U-shape, will typically be made up by mirror-symmetrical elements 8*a* and 8*b*, which together form a V-shape, and which thereby form a funnel, which will facilitate correct insertion of the cards into the card holder. When the card holder is closed, the angle of the V-shaped connecting pieces 8 will gradually become more acute, and the parts 8*a* and 8*b* will finally become virtually parallel.

If the holding device is made out a flexible, springy material, these connecting pieces 8, when closed, will provide a certain countervailing force to the closing motion, so that when the card holder is opened, the covers will be pushed apart automatically. It is, however, desirable to provide more force than what the above mentioned connecting pieces can provide, to assist in the opening of the card holder. This can conveniently be done by arranging one or two regular metal springs 10, in connection with the hinging of the covers.

A holding device produced as described above will, with a correct dimensioning of the distance between each of the paired surfaces which constitute the holding surfaces, keep the cards securely in position when the card holder is open as well as when it is closed.

With, for instance, a holding device made out of a thermoplastic material with a suitably slick surface, it is simple to device such a snug fit around the side edges of the cards that they may easily be inserted and pulled out, while still holding the cards so firmly that only a vigorous shaking of the card holder may cause them to fall out. With cards of normal thickness one will therefore not have to worry about a card accidentally falling out while the card holder is open.

At the same time one achieves an equally good or better protection of those areas of the cards that carry information, in so much as these areas will never rub against another card or any part of the holder. With sufficiently rigid cover walls, the cards will never be exposed to any mechanical bending or stretching force.

Furthermore, it is possible to manufacture the covers in a material which will offer additional protection of the cards by not admitting electromagnetic radiation, for instance from loudspeakers, mobile phones etc., or preferably, to line the covers on the inside with layers of such protective materials.

The fact that the holder springs open, makes it easy to see which cards lie where, and gives access for fingers to grasp the end of whatever card that is to be pulled out.

While the above described holding device has room for five cards, it goes without saying that it can be made to accommodate more or fewer cards. According to the invention there are two holding devices 5, 6, one on either side of the card holder. It is of course possible to provide connecting members between these so that they are physically connected and inseparable. This does not alter the basic principle behind the card holder, and such an arrangement should therefore be viewed as being covered by the invention.

It is preferable to arrange the covers in a way so that they can only be opened to an acute angle, a.o. to protect the holding device from outside forces. Variations of this design may however occur, depending a.o. on the dimensions of the holding device, the number of card slots it has, etc.

The description with reference to the drawings are only to be understood as exemplification of the invention, which is only limited by the patent claims.

What is claimed is:

1. Card holder for plastic cards with magnetically stored information, comprising:

a pair of external covers hinged together at one end thereof to open in intersecting planes, and including a pair of edges transverse to the hinged end and an opposite end, wherein each plane extends from the hinged end to the opposite end;

two paired, holding devices for holding a plurality of cards, each of said holding devices independently disposed between the covers and adjacent an opposed transverse edge of the covers, said holding devices being hinged together with the covers at one end of the holding devices, and having a plurality of paired, opposing holding surfaces having free ends opposite to the hinged end of the holding devices for receiving cards to be held, the paired holding devices being spaced apart by an amount sufficient that a card inserted between opposed holding surfaces adjacent each edge of the covers is retained adjacent opposed side edges of the card, said holding surfaces being substantially parallel with each other both when the card holder is open and closed.

2. Card holder as claimed in claim 1, wherein each of the covers at or near the opposite end comprises at least one mutually conjunctive locking mechanism to keep the card holder locked tightly when it is not being used.

3. Card holder as claimed in claim 2, wherein the locking mechanism comprises symmetrically arranged snap locks at opposite corners of the opposite edge.

4. Card holder as claimed in claim 2, additionally comprising at least one spring-loaded mechanism which exerts outward pressure on the hinged covers when closed, and which provides assistance in opening the card holder when the locking mechanism is released.

5. Card holder as claimed in claim 4, wherein the spring-loaded mechanism is substantially powered by at least one spring mounted concentrically with the hinges of the covers.

6. Card holder as claimed in claim 1, wherein the holding devices are substantially identical.

7. Card holder as claimed in claim 1, wherein the holding devices have such dimensions that when the card holder is closed, the cards retained within the holding devices lie substantially parallel in the card holder, with a distance between one card and an adjacent card of about 0.5–1 mm.

8. Card holder as claimed in claim 1, wherein each of the holding devices is constructed as a single integrated elastic unit having holding surfaces for the cards in the shape of a plurality of U-shaped pieces having at a closed end of each U-shaped piece a ring shaped hinge which is hinged together with the covers; and between free ends of adjacent U-shaped pieces there is a connecting piece which is shaped and dimensioned such that the connecting piece becomes compressed when the card holder is closed, the connecting piece being sufficiently elastic to exert a countervailing force against a closing motion, and a force that assists in the opening of the card holder.

9. Card holder as claimed in claim 1, wherein the holding surfaces are closed along outermost long edges by means of a side element.

10. Card holder as claimed in claim 1, wherein the holding surfaces have a width of 5–6 mm and a length of 20–35 mm.

11. Card holder as claimed in claim 1, wherein between free ends of adjacent paired holding surfaces there is a connecting piece which is shaped and dimensioned such that the connected connecting piece becomes compressed when the card holder is closed.

12. Card holder as claimed in claim 11, wherein the connecting pieces of a pair of parallel surfaces form a V-shape to facilitate card insertion.

13. Card holder as claimed in claim 11, wherein outermost connecting pieces of each holding device each bridges to a fixing device which is fixed to a corresponding cover.

* * * * *